US011686507B2

(12) United States Patent
Raimbault et al.

(10) Patent No.: US 11,686,507 B2
(45) Date of Patent: Jun. 27, 2023

(54) SYSTEMS AND METHODS FOR CONTROL OF SUPERHEAT FROM A SUBCOOLER

(71) Applicant: TRANE INTERNATIONAL INC., Davidson, NC (US)

(72) Inventors: Yves Jacques Raimbault, Uxegney (FR); Philippe Del Marcel Tisserand, Eloyes (FR); Qingnan Huang, Shanghai (CN); Marie Tallotte, Vincey (FR); Clément Reignier, Meurthe et Moselle (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/576,073

(22) Filed: Jan. 14, 2022

(65) Prior Publication Data

US 2022/0136742 A1 May 5, 2022

Related U.S. Application Data

(63) Continuation of application No. 16/944,847, filed on Jul. 31, 2020, now Pat. No. 11,226,140.

(30) Foreign Application Priority Data

Jul. 31, 2019 (CN) ..... 201910704097.7

(51) Int. Cl.
*F25B 13/00* (2006.01)
*F25B 41/26* (2021.01)
(Continued)

(52) U.S. Cl.
CPC ..... *F25B 13/00* (2013.01); *F25B 39/00* (2013.01); *F25B 40/00* (2013.01); *F25B 41/26* (2021.01);
(Continued)

(58) Field of Classification Search
CPC ..... F25B 2400/054
See application file for complete search history.

(56) References Cited

U.S. PATENT DOCUMENTS 5,341,649 A 8/1994 Nevitt et al.
8,974,688 B2 3/2015 Yana Motta et al.
(Continued)

FOREIGN PATENT DOCUMENTS

DE 102016103250 A1 * 9/2016 ..... B60H 1/3223
DE 102016103250 A1 9/2016
(Continued)

OTHER PUBLICATIONS

DE102016103250A1 Translation (Year: 2016).*
(Continued)

*Primary Examiner* — Schyler S Sanks
(74) *Attorney, Agent, or Firm* — Hamre, Schumann, Mueller & Larson, P.C.

(57) ABSTRACT

Systems and methods for controlled subcooling of working fluid in a heating, ventilation, air conditioning and refrigeration (HVACR) system through a suction line heat exchanger are disclosed. The suction line heat exchanger may receive a first fluid flow travelling to a suction of the compressor in the HVACR system and second flow of working fluid that is travelling from a heat exchanger receiving the discharge of the compressor to an expansion device. Superheating of the first working fluid may be determined based on temperature measurements prior to and following the suction line heat exchanger. The superheating may be used to control the quantity of the second flow of working fluid introduced into the suction line heat exchanger, for example to maintain superheat that is below a threshold value. These systems may include chillers and heat pump systems, and methods may be applied to chillers or heat pump systems.

8 Claims, 5 Drawing Sheets

(51) Int. Cl.

| | |
|---|---|
| ***F25B 41/30*** | (2021.01) |
| ***F25B 39/00*** | (2006.01) |
| ***F25B 40/00*** | (2006.01) |

(52) U.S. Cl.
CPC ..... *F25B 41/30* (2021.01); *F25B 2313/0292* (2013.01); *F25B 2313/0315* (2013.01); *F25B 2600/2515* (2013.01); *F25B 2700/2103* (2013.01)

(56) References Cited

U.S. PATENT DOCUMENTS

| | | | | |
|---|---|---|---|---|
| 9,797,639 | B2 | 10/2017 | Schmidt | |
| 2017/0268811 | A1* | 9/2017 | Ochiai | F25B 13/00 |
| 2018/0017292 | A1 | 1/2018 | Yana Motta et al. | |
| 2018/0201817 | A1 | 7/2018 | Close et al. | |
| 2019/0153283 | A1 | 5/2019 | Yana Motta et al. | |
| 2020/0132385 | A1* | 4/2020 | Choi | F25B 40/00 |

FOREIGN PATENT DOCUMENTS

| | | | | |
|---|---|---|---|---|
| GB | 2508614 | A | 6/2014 | |
| GB | 2553970 | A | 3/2018 | |
| WO | 2012000501 | A2 | 1/2012 | |
| WO | 2017029534 | A1 | 2/2017 | |
| WO | 2017140488 | A1 | 8/2017 | |
| WO | 2019004681 | A1 | 1/2019 | |
| WO | WO-2019004681 | A1 * | 1/2019 | A47F 3/04 |

OTHER PUBLICATIONS

WO2019004681A1 Translation (Year: 2019).*
Extended European Search Report; European Patent Application No. 20188891.4, dated Dec. 22, 2020 (6 pages).

* cited by examiner

SYSTEMS AND METHODS FOR CONTROL OF SUPERHEAT FROM A SUBCOOLER

FIELD

This disclosure is directed to systems and methods for the control of superheat generated by a subcooler in a heating, ventilation, air conditioning, and refrigeration (HVACR) system.

BACKGROUND

Subcooling can increase the difference in enthalpy between the condenser and the evaporator in a heating, ventilation, air conditioning, and refrigeration (HVACR) system. This can improve the capacity and efficiency of an HVACR system over the capacity and efficiency of an HVACR system having identical values for the suction and discharge pressure of a compressor included in that HVACR system.

SUMMARY

This disclosure is directed to systems and methods for the control of superheat generated by a subcooler in a heating, ventilation, air conditioning, and refrigeration (HVACR) system.

Subcooling can be provided to an HVACR system using a suction line heat exchanger, where working fluid can release additional heat prior to entering an expansion device, and the heat can be absorbed by working fluid that is about to enter a suction of a compressor of the HVACR system. This subcooling can provide efficiency advantages.

Excessive subcooling may have detrimental effects on HVACR system performance. Depending on the operating mode of the HVACR system, excessive subcooling can result in issues including liquid slugging, or potentially freezing at one of the heat exchangers of the HVACR system, and thus may require defrost cycles which cost efficiency.

Providing controlled subcooling through a suction line heat exchanger may allow the advantages of subcooling with respect to capacity and efficiency to be realized while avoiding some of the associated risks or problems resulting from excessive subcooling. Control may be achieved by using a flow director to control a portion of the flow through a suction line heat exchanger, based on the superheat added to the suction line working fluid by the subcooled refrigerant. In some embodiments, the improvements to efficiency can be improvements to overall efficiency of heat pump operations, such as increase of heating capacity and reduction in power when at maximum heating capacity. In an embodiment, the controlled subcooling can provide an overall efficiency of heat pump operations of approximately 8%, for example by increasing the heating capacity by approximately 4% while also reducing energy consumption at maximum heating capacity by approximately 4%.

An HVACR circuit embodiment includes a compressor having a suction and a discharge, a first heat exchanger, an expander, a second heat exchanger, and a suction line heat exchanger. The suction line heat exchanger is configured to exchange heat between a first working fluid flow, where the first working fluid flow is a flow of working fluid from one of the first heat exchanger and the second heat exchanger to the suction of the compressor, and a second working fluid flow, where the second working fluid flow is a flow of working fluid from the other of the first heat exchanger and the second heat exchanger towards the expander. The HVACR circuit further includes a flow director configured to regulate an amount of the second working fluid flow entering the suction line heat exchanger. The HVACR circuit also includes a controller, configured to receive a first temperature of the first working fluid flow prior to entering the suction line heat exchanger, receive a second temperature of the first working fluid flow between the suction line heat exchanger and the suction of the compressor, determine a superheat generation at the suction line heat exchanger based on the first temperature and the second temperature; and control the flow director based on the superheat generation and a threshold superheat value.

In an embodiment, the HVACR circuit further includes a third temperature sensor configured to measure a temperature of the second working fluid flow prior to entering the flow director or at an inlet of the flow director, and the controller is configured to further control the flow director based on a reading from the third temperature sensor.

In an embodiment, in the HVACR circuit, the first heat exchanger is an outdoor heat exchanger receiving working fluid from the discharge of the compressor, the second heat exchanger is an evaporator, the first working fluid flow is from the second heat exchanger to the suction of the compressor, and the second working fluid flow is from the first heat exchanger to the expander.

In an embodiment, the HVACR circuit further includes a flow reverser configured to direct a discharge of the compressor to one of the first heat exchanger and the second heat exchanger. In an embodiment, the HVACR circuit is in a cooling mode when the flow reverser directs a discharge of the compressor to the first heat exchanger, and a heating mode when the flow reverser directs the discharge of the compressor to the second heat exchanger. In an embodiment, when the HVACR circuit is in the cooling mode, the first working fluid flow is from the second heat exchanger to the suction of the compressor, and the second working fluid flow is from the first heat exchanger to the expander. In an embodiment, when the HVACR circuit is in the heating mode, the first working fluid flow is from the first heat exchanger to the suction of the compressor, and the second working fluid flow is from the second heat exchanger to the expander.

In an embodiment, the suction line heat exchanger is a counter-flow heat exchanger.

In an embodiment, the flow director includes a stepped three-way valve and a bypass line.

In an embodiment, the flow director includes a plurality of controllable valves, and wherein the controller is configured to operate the plurality of controllable valves proportionally.

In an embodiment, controlling the flow director based on the superheat generation and a threshold superheat value comprises regulating the second working fluid flow such that the superheat generation is less than the threshold superheat value. In an embodiment, the threshold superheat value is at or about 4° C.

In an embodiment, the HVACR circuit includes a first temperature sensor located upstream of the suction line heat exchanger with respect to the first working fluid flow, and wherein the controller receives the first temperature from the first temperature sensor.

In an embodiment, the HVACR circuit includes a second temperature sensor located between the suction line heat exchanger and the suction of the compressor, and wherein the controller receives the second temperature from the second temperature sensor.

In an embodiment, a method of operating an HVACR circuit includes providing a first working fluid flow through a suction line heat exchanger, wherein the first working fluid flow is a working fluid flow from a first heat exchanger to a suction of a compressor and providing a second working fluid flow through the suction line heat exchanger, separate from the first working fluid flow. The second working fluid flow is a working fluid flow from a second heat exchanger to an expander, and the first working fluid flow and the second working fluid flow exchange heat in the suction line heat exchanger. The method includes receiving a first temperature of the first working fluid flow at a position directly upstream of the suction line heat exchanger and receiving a second temperature of the first working fluid flow at a position directly downstream of the suction line heat exchanger. The method further includes determining a superheat generation based on the first temperature and the second temperature. The method also includes controlling a quantity of flow of the second working fluid flow through the suction line heat exchanger based on the superheat generation and a threshold superheat value.

In an embodiment, the quantity of flow of the second working fluid flow is controlled such that the superheat generation does not exceed the threshold superheat value. In an embodiment, the threshold superheat value is at or about 4° C.

In an embodiment, controlling the quantity of flow of the second working fluid flow includes directing a portion of the second working fluid flow to a bypass line via a stepped three-way valve.

In an embodiment, controlling the quantity of flow of the second working fluid flow includes operating a plurality of controllable valves proportionally to allocate flow between a bypass line and the suction line heat exchanger.

In an embodiment, the method further includes receiving a third temperature, wherein the third temperature is a temperature of the second working fluid flow, and controlling the quantity of flow of the second working fluid flow is further based on the third temperature.

In an embodiment, the suction line heat exchanger is a counter-flow heat exchanger wherein the first working fluid flow travels through the suction line heat exchanger in a first direction, and the second working fluid flow travels through the suction line heat exchanger in a second direction, wherein the second direction is opposite the first direction.

In an embodiment, the HVACR circuit is a heat pump circuit, the first heat exchanger is a heat exchanger receiving working fluid from the expander, and the second heat exchanger is a heat exchanger receiving working fluid from a discharge of the compressor.

DRAWINGS

DETAILED DESCRIPTION

This disclosure is directed to systems and methods for the control of superheat generated by a subcooler in a heating, ventilation, air conditioning, and refrigeration (HVACR) system.

Figure 1:
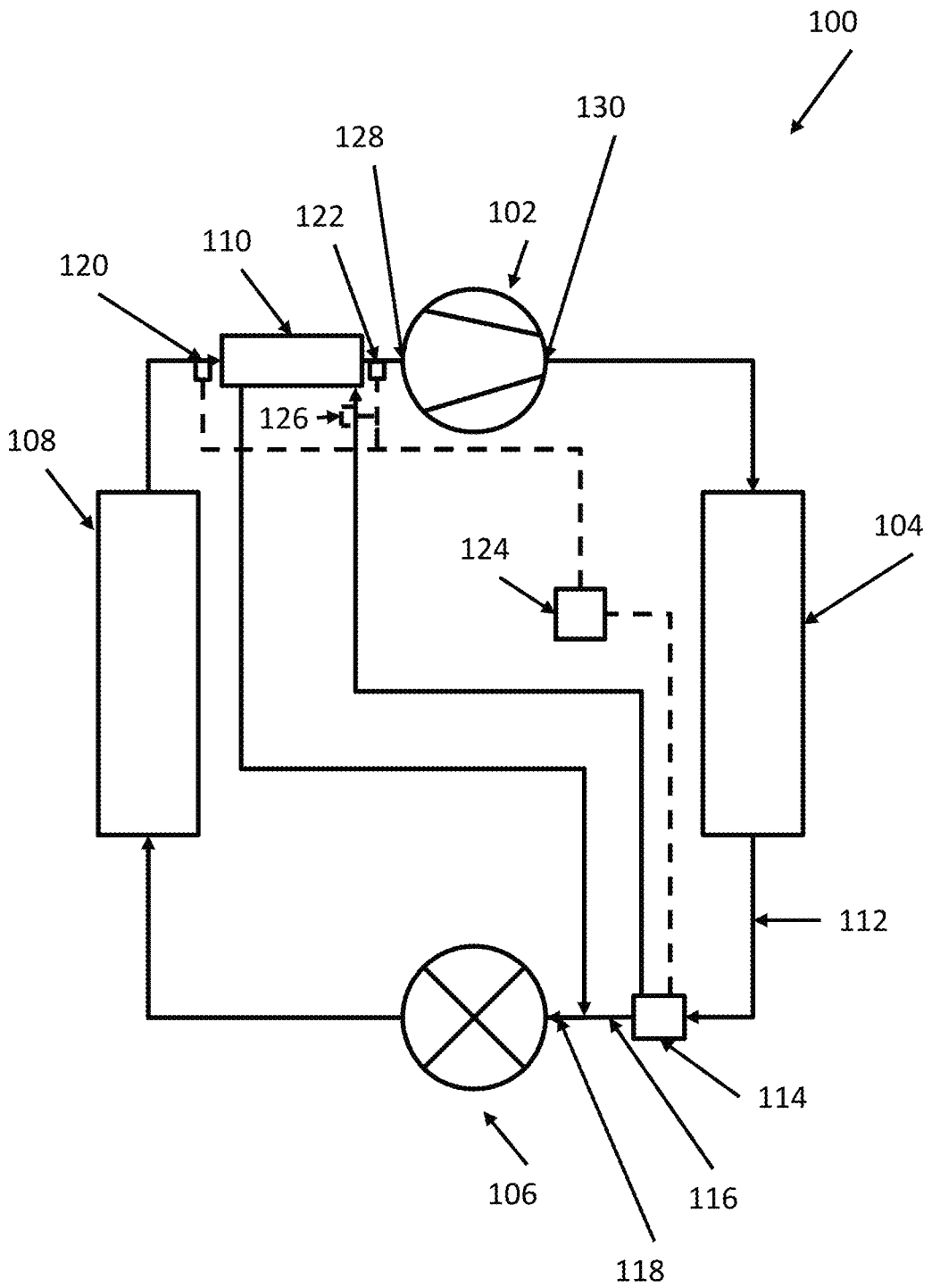
FIG. 1 is a schematic of a heating, ventilation, air conditioning, and refrigeration (HVACR) circuit according to an embodiment.

FIG. 1 is a schematic of a heating, ventilation, air conditioning, and refrigeration (HVACR) circuit 100 according to an embodiment. HVACR circuit 100 includes compressor 102, first heat exchanger 104, expansion device 106, second heat exchanger 108, and suction line heat exchanger 110. HVACR circuit further includes fluid line 112, flow director 114, bypass line 116, and return line 118. HVACR circuit 100 also includes first temperature sensor 120 and second temperature sensor 122. HVACR circuit 100 further includes controller 124. HVACR circuit 100 may optionally include a third temperature sensor 126.

Compressor 102 is a compressor that compresses a working fluid of the HVACR circuit 100. Compressor 102 may be any suitable type of compressor for an HVACR system such as, for example, a screw compressor or a scroll compressor. Compressor 102 includes suction 128, where the working fluid enters the compressor 102, and discharge 130, where compressed working fluid exits the compressor 102.

First heat exchanger 104 receives the compressed working fluid exiting from discharge 130 of compressor 102. First heat exchanger 104 may be a condenser configured to allow the working fluid to release heat, for example to another fluid, condensing the working fluid. In an embodiment where HVACR circuit 100 is part of an air-cooled chiller, first heat exchanger 104 may be an outdoor condenser configured to exchange heat between the working fluid and ambient outdoor air to condense the compressed working fluid. In an embodiment, working fluid exits first heat exchanger 104 via fluid line 112.

Expansion device 106 is a device configured to reduce the pressure of the working fluid. Expansion device 106 is an expander. As a result of reduction in the pressure in the working fluid at expansion device 106, a portion of the working fluid is converted to a gaseous form. Expansion device 106 may be, for example, an expansion valve, orifice, or other suitable expander to reduce pressure of a working fluid such as the working fluid. In an embodiment, expansion device 106 includes multiple orifices. In an embodiment, the multiple orifices of expansion device 106 have different sizes. Expansion device 106 may be a controllable expansion device having a variable aperture. In an embodiment, expansion device 106 is an electronic expansion valve.

Second heat exchanger 108 is a heat exchanger receiving working fluid from expansion device 106. In an embodiment where HVACR circuit 100 is part of a chiller, second heat exchanger may be an evaporator configured to exchange heat between the working fluid and a process fluid such as water or air to provide cooling to a building having climate control provided by a system including the HVACR circuit 100. In this embodiment, the working fluid in second heat exchanger 108 may absorb heat from the process fluid to evaporate the working fluid. The working fluid exiting second heat exchanger 108 may pass to suction line heat exchanger 110.

Suction line heat exchanger 110 is a heat exchanger allowing the exchange of heat between two working fluid flows through HVACR circuit 100. Suction line heat exchanger 110 may receive a first flow of working fluid from second heat exchanger 108, which then passes to suction 128 of compressor 102 following the exchange of heat within suction line heat exchanger 110. Suction line heat exchanger 110 may receive a second flow of working fluid from flow director 114, which then passes to return line 118 following the exchange of heat within suction line heat exchanger 110. Suction line heat exchanger 110 may be any suitable form of heat exchanger for exchanging heat between the first and second flows of working fluid. In an embodiment, suction line heat exchanger 110 is constructed of one or more steel materials. In an embodiment, suction line heat exchanger 110 does not include copper. In an embodiment, suction line heat exchanger 110 includes a plurality of tubes conveying the first flow of working fluid, located within an outer pipe through which the second flow of working fluid travels. In an embodiment, suction line heat exchanger 110 is a counter-flow heat exchanger where the first flow of working fluid and the second flow of working fluid travel in opposite directions.

Fluid line 112 may direct the fluid exiting heat exchanger 104 to flow director 114. Flow director 114 allocates the flow from fluid line 112 among the suction line heat exchanger 110 and a bypass line 116. Flow director 114 may be any one or more flow controls that are configured to allow a variable amount of the flow exiting heat exchanger 104 to be directed to the suction line heat exchanger 110. Flow director 114 may regulate the flow entering suction line heat exchanger 110 based on control by controller 124. Bypass line 116 is a fluid line that conveys fluid from flow director 114 to return line 118 without passing through suction line heat exchanger 110. Return line 118 is a line that conveys fluid received from suction line heat exchanger 110 and bypass line 116 to the expansion device 106.

Flow director 114 may be, for example, a three-way valve. In an embodiment, flow director 114 is a motorized, stepped three-way valve. In an embodiment where flow director 114 is a three-way valve, the three-way valve has one input receiving flow from fluid line 112, a first outlet from which fluid passes to suction line heat exchanger 110, and a second outlet from which fluid passes to bypass line 116.

In an embodiment, flow director 114 includes at least two variable-position valves. In this embodiment, the at least two variable-position valves may be controlled in a complementary fashion, where the extent of opening of each valve is controlled with respect to the others to allocate the flow among suction line heat exchanger 110 and bypass line 116. This complementary control may be proportional, for example, having the aperture of the variable-position valve controlling flow to suction line heat exchanger 110 be set to a size proportional to the amount of flow to be directed to the suction line heat exchanger 110 while also having the variable-position valve controlling flow to bypass line 116 be set to a size proportional to the amount of flow to be directed to the bypass line 116. Proportional control of valves in flow director 114 may be directed by controller 124.

In an embodiment, flow director 114 includes multiple valves of varying aperture size for each of suction line heat exchanger 110 and bypass line 116 and the allocation of flow is achieved by opening or closing one or more of those multiple valves.

In an embodiment, first temperature sensor 120 is a temperature sensor located directly upstream of or at an inlet of the suction line heat exchanger 110 with respect to the flow of working fluid through the HVACR circuit 100. First temperature sensor 120 is a sensor configured to obtain a temperature value, either directly or indirectly. First temperature sensor 120 may obtain a first temperature reading that is a temperature of the first working fluid flow prior to the first working fluid flow exchanging heat in the suction line heat exchanger 110. The first temperature sensor 120 may be any suitable temperature sensor for measuring a temperature of a working fluid flow prior to that working fluid flow entering the suction line heat exchanger 110. First temperature sensor 120 may be operatively coupled to controller 124 such that it can provide a first temperature reading to controller 124. The operative coupling may be through any suitable connection to provide the first temperature reading, such as wired or wireless communications.

In an embodiment, second temperature sensor 122 is a temperature sensor located directly downstream of or at an outlet of the suction line heat exchanger 110 with respect to the flow of working fluid through the HVACR circuit 100. Second temperature sensor 122 is a sensor configured to obtain a temperature value, either directly or indirectly. Second temperature sensor 122 may obtain a second temperature reading that is the temperature of the first working fluid flow subsequent to that working fluid flow exchanging heat at suction line heat exchanger 110. Second temperature sensor 122 is upstream of the compressor 102. Second temperature sensor 122 may be operatively coupled to controller 124 such that it can provide the second temperature reading to controller 124. The operative coupling may be through any suitable connection to provide the second temperature reading, such as wired or wireless communications.

Controller 124 includes a processor. Controller 124 is operatively coupled to first temperature sensor 120 and second temperature sensor 122. Controller 124 is further operatively coupled to flow director 114 such that the quantity of flow to suction line heat exchanger 110 can be controlled. Controller 124 may be configured to receive a first temperature from the first temperature sensor. Controller 124 may be configured to receive a second temperature from the second temperature sensor. Controller 124 may be configured to determine a superheat generation at the suction line heat exchanger based on the first temperature and the second temperature. In an embodiment, the superheat generation is determined by subtracting the first temperature from the second temperature. Controller 124 may further be configured to control the flow director 114 based on the superheat generation and a threshold superheat value. Controller 124 may include a memory, and the memory may be configured to store at least the threshold superheat value. The threshold superheat value may be a value of superheat that is permissible for HVACR circuit 100 during operations. The threshold superheat value may be based on parameters such as, for example, the design of the HVACR circuit 100, and optionally the amount of working fluid that HVACR circuit 100 has been charged with. In an embodiment, the threshold superheat value is determined based on a superheat setpoint of the HVACR circuit 100. In an embodiment, the threshold superheat value may be at or about 4° C. The threshold superheat value may be a value selected based on one or more of, for example, avoiding liquid slugging or improving stability at the expansion device 106. The threshold superheat value may further be dynamic with the variation in the threshold superheat value being based at least in part on, for example, ambient air temperature, saturated suction temperature, and/or compressor load of compressor 102.

Optionally, third temperature sensor 126 may be included in HVACR circuit 100. Third temperature sensor 126 may be located along fluid line 112. Third temperature sensor 126 may be any suitable temperature sensor for measuring a temperature of the working fluid within fluid line 112. Third temperature sensor 126, when included, may measure a third temperature reading that is a temperature of the second working fluid flow that introduced into suction line heat exchanger 110. Third temperature sensor 126, when included, may be operatively coupled to controller 124 such that it can provide the third temperature reading to controller 124. The operative coupling may be through any suitable connection to provide the second temperature reading, such as wired or wireless communications. In an embodiment where third temperature sensor 126 is included, the controller 124 may be further configured to determine the amount of flow for flow director 114 to allow into suction line heat exchanger 110 based on the third temperature reading.

Figure 2A:
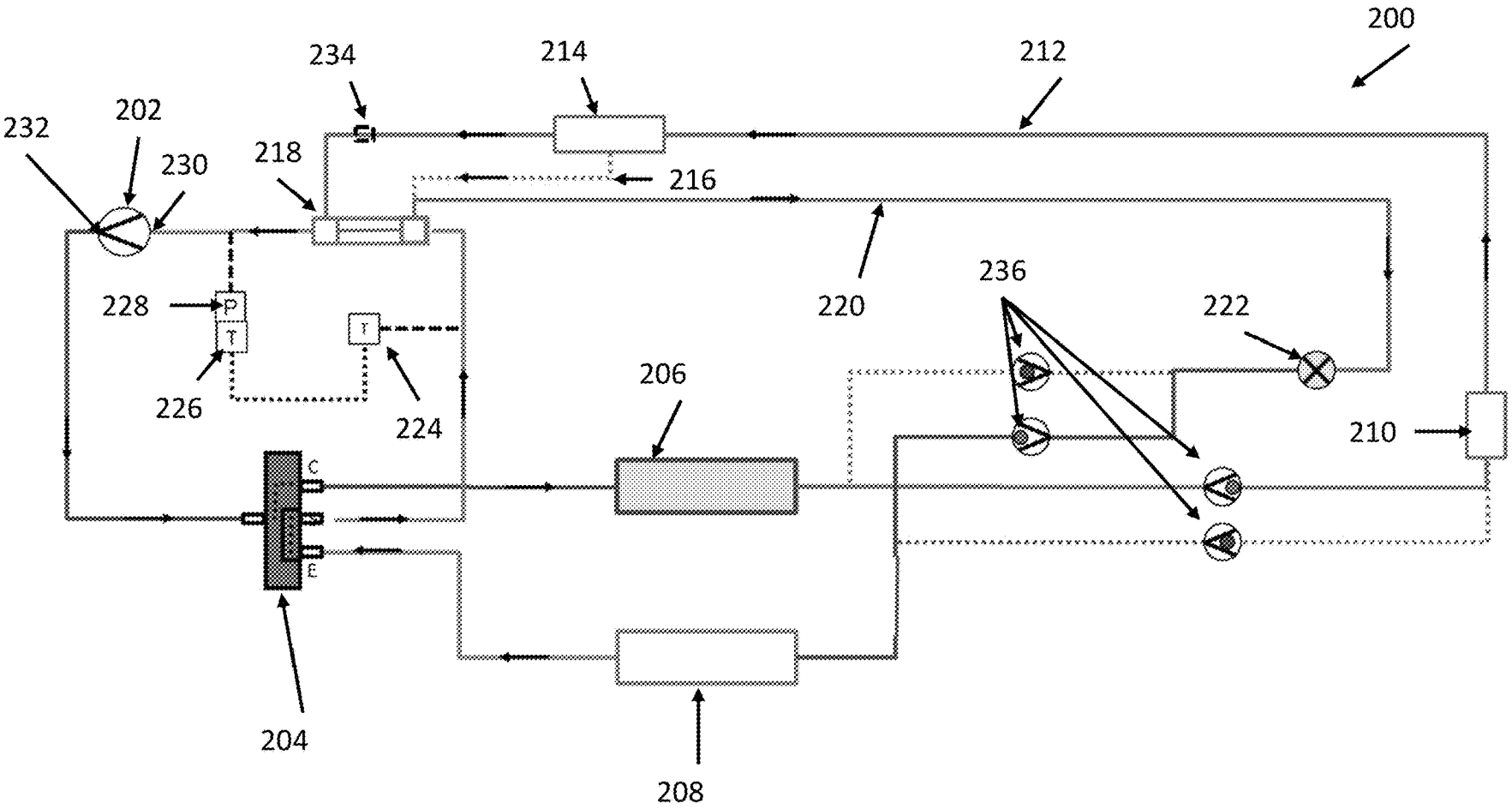
FIG. 2A is a schematic of an HVACR circuit according to an embodiment, wherein the HVACR circuit includes a heat pump in a cooling mode.

FIG. 2A is a schematic of an HVACR circuit 200 according to an embodiment, wherein the HVACR circuit includes a heat pump in a cooling mode. HVACR circuit 200 includes compressor 202, flow reverser 204, first heat exchanger 206 and second heat exchanger 208. HVACR circuit 200 optionally includes drier 210. HVACR circuit 200 includes fluid line 212 which conveys fluid to flow director 214. Flow director 214 allocates flow among bypass line 216 and suction line heat exchanger 218. Suction line heat exchanger 218 and bypass line 216 convey fluid to return line 220. HVACR circuit 200 further includes expansion device 222. HVACR circuit 200 further includes first temperature sensor 224 and second temperature sensor 226. HVACR circuit 200 also includes controller 228. Optionally, third temperature sensor 234 may also be included in HVACR circuit 200.

In the cooling mode shown in FIG. 2A, flow reverser 204 directs the discharge of compressor 202 to first heat exchanger 206. In the cooling mode shown in FIG. 2A, check valves 236 permit the flow of the working fluid from the first heat exchanger 206 to optional drier 210 or fluid line 212.

Compressor 202 includes suction 230 and discharge 232. Compressor 202 is a compressor that compresses a working fluid of the HVACR circuit 200. Compressor 202 may be, for example, any suitable type of compressor for an HVACR system, such as a screw compressor. Compressor 202 includes suction 230, where the working fluid enters the compressor 202, and discharge 232, where compressed working fluid exits the compressor 202.

Flow reverser 204 is a flow control configured to allow the direction of flow through HVACR circuit 200 to be switched between a first direction and a second direction, opposite the first. In an embodiment, flow reverser 204 is a four-way valve. In an embodiment where flow reverser 204 is a four-way valve, the four-way valve may have a first connection to the discharge 232 of compressor 202, a second connection to first heat exchanger 206, a third connection to the second heat exchanger 208, and a fourth connection to the suction line heat exchanger 218. In this embodiment, when HVACR circuit 200 is in a cooling mode, the first connection to discharge 232 is connected to the third connection to second heat exchanger 208, and the second connection to first heat exchanger 206 is connected to the fourth connection to the suction line heat exchanger 218.

First heat exchanger 206 is a heat exchanger allowing the working fluid to exchange heat as part of a heating or cooling operation of HVACR circuit 200. In an embodiment, first heat exchanger 206 is an outdoor heat exchanger. In an embodiment, in the cooling mode, first heat exchanger 206 receives working fluid compressed by the compressor 202 from flow reverser 204. In this embodiment, in the cooling mode, first heat exchanger 206 operates as a condenser allowing the compressed working fluid to reject heat to an ambient environment. In this embodiment, in the cooling mode, the working fluid leaving the first heat exchanger 206 then travels to one of optional drier 210 and flow director 214 via fluid line 212.

Second heat exchanger 208 is another heat exchanger separate from first heat exchanger 206. In an embodiment, second heat exchanger 208 creates a heat exchange relationship between the working fluid and a process fluid such as water or air. In an embodiment, in the cooling mode, the second heat exchanger 208 receives working fluid from expansion device 222. In this embodiment, in the cooling mode, the second heat exchanger functions as an evaporator where the working fluid absorbs heat from the process fluid to provide cooling to a space serviced by an HVACR system including HVACR circuit 200. In this embodiment, in the cooling mode, the working fluid exiting the second heat exchanger 208 passes to flow reverser 204.

HVACR circuit 200 may optionally include drier 210. Drier 210 may receive working fluid from the first heat exchanger 206 when HVACR circuit 200 is in the cooling mode as shown in FIG. 2A.

Fluid line 212 conveys the working fluid in HVACR circuit 200 to flow director 214. In an embodiment including optional drier 210, the fluid line 212 may be from drier 210 to flow director 214. In an embodiment, fluid line 212 may receive working fluid from the first heat exchanger 206 when the HVACR circuit 200 is in the cooling mode as shown in FIG. 2A Flow director 214 receives working fluid from fluid line 212. Flow director 214 allocates the received working fluid among bypass line 216 and suction line heat exchanger 218. By controlling the amount of working fluid allocated to suction line heat exchanger 218, the superheat and subcooling occurring at suction line heat exchanger 218 can be controlled. The allocation of working fluid among bypass line 216 and suction line heat exchanger 218 may be determined by controller 228, which may direct flow director 214 to allocate the flow according to a command.

Flow director 214 may be, for example, a three-way valve. In an embodiment, flow director 214 is a motorized, stepped three-way valve. In an embodiment where flow director 214 is a three-way valve, the three-way valve has one input receiving flow from fluid line 212, a first outlet from which fluid passes to suction line heat exchanger 218, and a second outlet from which fluid passes to bypass line 216.

In an embodiment, flow director 214 includes at least two variable-position valves. In this embodiment, the at least two variable-position valves may be controlled in a complementary fashion, where the extent of opening of each valve is controlled with respect to the others to allocate the flow among suction line heat exchanger 218 and bypass line 216. This complementary control may be proportional, for example, having the aperture of the variable-position valve controlling flow to suction line heat exchanger 218 be set to a size proportional to the amount of flow to be directed to the suction line heat exchanger 218 while also having the variable-position valve controlling flow to bypass line 216 be set to a size proportional to the amount of flow to be directed to the bypass line 216. Proportional control of valves in flow director 214 may be directed by controller 228.

In an embodiment, flow director 214 includes multiple valves of varying aperture size for each of suction line heat exchanger 218 and bypass line 216 and the allocation of flow is achieved by opening or closing one or more of those multiple valves.

Bypass line 216 allows fluid from flow director 214 to pass to return line 220 without passing through suction line heat exchanger 218. Bypass line 216 may receive working fluid from flow director 214, depending on the amount of fluid directed to suction line heat exchanger 218.

Suction line heat exchanger 218 allows a first flow of working fluid from flow reverser 204 to suction 230 of compressor 202 to exchange heat with a second flow of working fluid from flow director 214. In an embodiment, the first flow of working fluid is a suction gas. In an embodiment, the second flow of working fluid is a liquid at a relatively higher temperature than the first flow of working fluid. In an embodiment, heat exchange at suction line heat exchanger superheats the first flow of working fluid and subcools the second flow of working fluid. In an embodiment, a quantity of fluid included in the second flow of working fluid affects the extent of superheating and/or subcooling occurring as a result of the heat exchange at suction line heat exchanger 218. In an embodiment, the first flow of working fluid travels through a plurality of tubes and the second flow of working fluid travels through an outer pipe surrounding the plurality of tubes. In an embodiment, the suction line heat exchanger 218 includes a steel material. In an embodiment, suction line heat exchanger 218 does not include copper. In an embodiment, suction line heat exchanger is a counter flow heat exchanger where the first working fluid flow and the second working fluid flow travel in opposite directions through suction line heat exchanger 218.

Return line 220 receives the working fluid from the bypass line 216 and the second working fluid flow exiting the suction line heat exchanger 218, and conveys the received working fluid to expansion device 222.

Expansion device 222 is a device configured to reduce the pressure of the working fluid. As a result, a portion of the working fluid is converted to a gaseous form. Expansion device 222 may be, for example, an expansion valve, orifice, or other suitable expander to reduce pressure of a working fluid such as the working fluid. In an embodiment, expansion device 222 includes multiple orifices. In an embodiment, the multiple orifices of expansion device 222 have different sizes. Expansion device 222 may be a controllable expansion device having a variable aperture. In an embodiment, expansion device 222 is an electronic expansion valve.

First temperature sensor 224 is a temperature sensor located directly upstream of or at an inlet of the suction line heat exchanger 218 with respect to the flow of working fluid through the HVACR circuit 200. First temperature sensor 224 may be located between the fourth connection of the flow reverser 204 and the suction line heat exchanger 218. First temperature sensor 224 may obtain a first temperature reading that is a temperature of the first working fluid flow prior to the first working fluid flow exchanging heat in the suction line heat exchanger 218. The first temperature sensor 224 may be any suitable temperature sensor for measuring a temperature of a working fluid flow prior to that working fluid flow entering the suction line heat exchanger 218. First temperature sensor 224 may be operatively coupled to controller 228 such that it can provide a first temperature reading to controller 228. The operative coupling may be through any suitable connection to provide the first temperature reading, such as wired or wireless communications.

Second temperature sensor 226 is a temperature sensor located directly downstream of or at an outlet of the suction line heat exchanger 218 with respect to the flow of working fluid through the HVACR circuit 200. Second temperature sensor 226 may obtain a second temperature reading that is the temperature of the first working fluid flow subsequent to that working fluid flow exchanging heat at suction line heat exchanger 218. Second temperature sensor 226 is upstream of the compressor 202. Second temperature sensor 226 may be operatively coupled to controller 228 such that it can provide the second temperature reading to controller 228. The operative coupling may be through any suitable connection to provide the second temperature reading, such as wired or wireless communications.

Controller 228 includes a processor. Controller 228 is operatively coupled to first temperature sensor 224 and second temperature sensor 226. Controller 228 is further operatively coupled to flow director 214 such that the quantity of flow to suction line heat exchanger 218 can be controlled. Controller 228 may be configured to receive a first temperature from the first temperature sensor. Controller 228 may be configured to receive a second temperature from the second temperature sensor. Controller 228 may be configured to determine a superheat generation at the suction line heat exchanger based on the first temperature and the second temperature. In an embodiment, the superheat generation is determined by subtracting the first temperature from the second temperature. Controller 228 may further be configured to control the flow director 214 based on the superheat generation and a threshold superheat value. Controller 228 may include a memory, and the memory may be configured to store at least the threshold superheat value. The threshold superheat value may be a value of superheat that is permissible for HVACR circuit 200 during operations. The threshold superheat value may be based on parameters such as, for example, the design of the HVACR circuit 200, and optionally the amount of working fluid that HVACR circuit 200 has been charged with. In an embodiment, the threshold superheat value is determined based on a superheat setpoint of the HVACR circuit 100. In an embodiment, the threshold superheat value may be at or about 4° C. The threshold superheat value may be a value selected based on one or more of, for example, avoiding liquid slugging or improving stability at the expansion device 222. The threshold superheat value may further be dynamic with the variation in the threshold superheat value being based at least in part on, for example, ambient air temperature, saturated suction temperature, and/or compressor load of compressor 202.

Optionally, third temperature sensor 234 may be included in HVACR circuit 200. Third temperature sensor 234 may be located between flow director 214 and suction line heat exchanger 218. Third temperature sensor 234 may be any suitable temperature sensor for measuring a temperature of the working fluid between flow director 214 and suction line heat exchanger 218. Third temperature sensor 234, when included, may measure a third temperature reading that is a temperature of the second working fluid flow that introduced into suction line heat exchanger 218. Third temperature sensor 234, when included, may be operatively coupled to controller 228 such that it can provide the third temperature reading to controller 228. The operative coupling may be through any suitable connection to provide the third temperature reading, such as wired or wireless communications. In an embodiment where third temperature sensor 234 is included, the controller 228 may be further configured to determine the amount of flow for flow director 214 to allow into suction line heat exchanger 218 based on the third temperature reading.

Figure 2B:
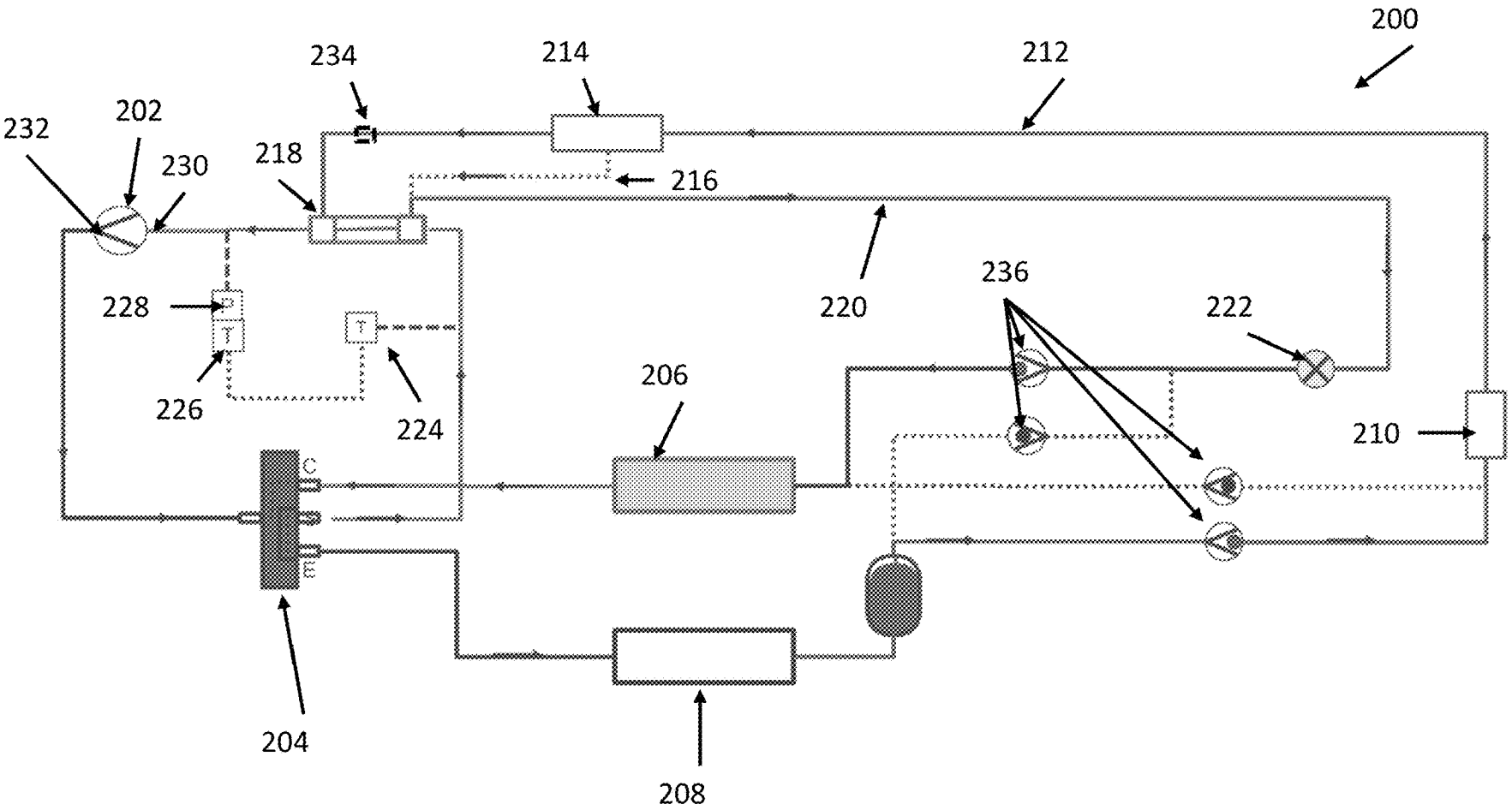
FIG. 2B is a schematic of an HVACR circuit according to an embodiment, wherein the HVACR circuit includes a heat pump in a heating mode.

FIG. 2B is a schematic of an HVACR circuit 200 according to an embodiment, wherein the HVACR circuit includes a heat pump in a heating mode. The HVACR circuit 200 includes the components discussed above in FIG. 2A. In the heating mode shown in FIG. 2B, flow reverser 204 directs the discharge of compressor 202 to second heat exchanger 208. In the heating mode shown in FIG. 2B, check valves 236 permit the flow of the working fluid from the second heat exchanger 208 to optional drier 210 or fluid line 212.

When HVACR circuit 200 is in a heating mode as shown in FIG. 2B, the first connection to discharge 232 is connected to the second connection to first heat exchanger 206 and the third connection to second heat exchanger 208 is connected to the fourth connection to the suction line heat exchanger 218.

When HVACR circuit 200 is in a heating mode as shown in FIG. 2B, second heat exchanger 208 receives process fluid compressed by compressor 202 via the flow reverser 204. In this embodiment, in the heating mode, the second heat exchanger 208 operates as a condenser allowing the compressed working fluid to reject heat to the process fluid to provide heating to the space served by the HVACR system including HVACR circuit 200. In this embodiment, in the heating mode, the working fluid leaving the second heat exchanger then travels to one of optional drier 210 and flow director 214 via fluid line 212.

Drier 210 may receive working fluid from the heat exchanger 208 when the HVACR circuit 200 is in a heating mode as shown in FIG. 2B.

In an embodiment, fluid line 212 may receive working fluid from the second heat exchanger 208 when the HVACR circuit 200 is in a heating mode as shown in FIG. 2B When HVACR circuit 200 is in the heating mode as shown in FIG. 2B, first heat exchanger 206 receives working fluid from expansion device 222. In an embodiment, in the heating mode, first heat exchanger 206 functions as an evaporator where the working fluid absorbs heat from the ambient environment. In this embodiment, in the heating mode, the working fluid exiting the first heat exchanger 206 passes to flow reverser 204.

Figure 3A:
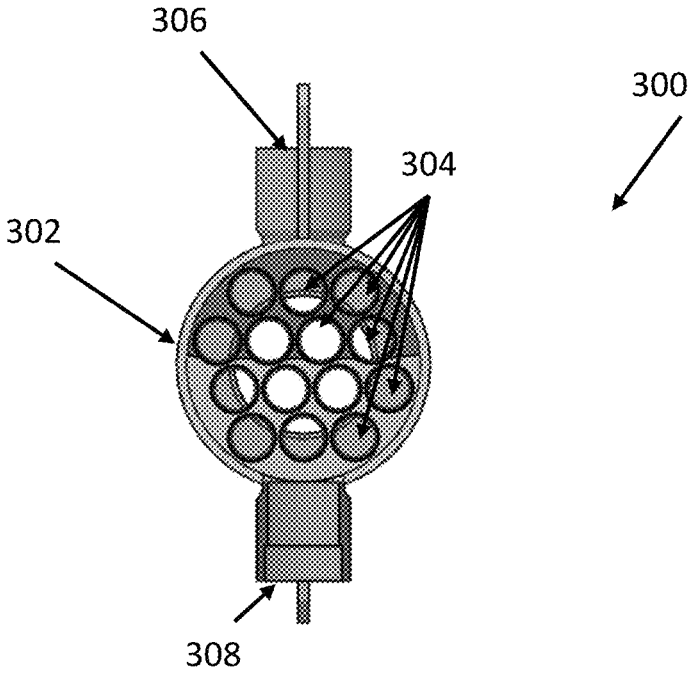
FIG. 3A is a crosswise sectional view of a suction line heat exchanger according to an embodiment.

FIG. 3A is a sectional view of a suction line heat exchanger 300 according to an embodiment. Suction line heat exchanger 300 includes outer pipe 302 and a plurality of tubes 304. Outer pipe 302 conveys a flow of liquid working fluid, from a heat exchanger of the HVACR circuit towards an expansion device of that HVACR circuit. Tubes 304 convey another flow of gaseous working fluid, from another heat exchanger of an HVACR circuit towards a suction of a compressor of that HVACR circuit. The flow of liquid working fluid enters through inlet 306 and exits through outlet 308. In an embodiment, the working fluid in tubes 304 absorbs heat from the working fluid in outer pipe 302, superheating the suction gas while subcooling the liquid working fluid. In an embodiment, the suction line heat exchanger 300 is a counter-flow heat exchanger, where a direction of the first flow of the working fluid in outer pipe 302 is opposite a direction of the second flow of the working fluid in tubes 304, such as the flow within outer pipe 302 being out of the page, whereas the flow of the working fluid in tubes 304 being into of the page.

Figure 3B:
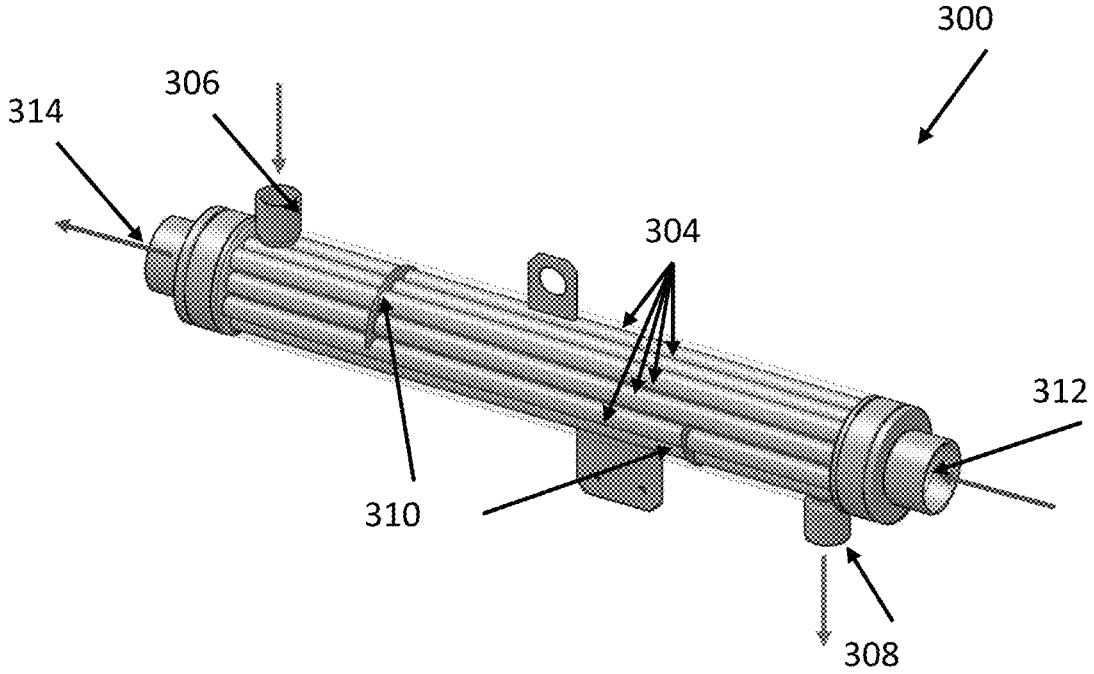
FIG. 3B is a schematic view of the suction line heat exchanger of FIG. 3A according to an embodiment.

FIG. 3B is a schematic view of the suction line heat exchanger 300 according to an embodiment. In FIG. 3B, outer tube 302 is not shown so that tubes 304 and baffles 310 can be shown. Inlet 306 and outlet 308 are shown. Inlet 306 allows the first flow of the working fluid to enter outer pipe 302. The flow of liquid working fluid is directed by baffles 310 as it passes through outer pipe 302 to outlet 308. The flow of gaseous working fluid passes from gas inlet 312 to gas outlet 314 via the tubes 314. In an embodiment, the direction of the flow of gaseous working fluid is opposite the direction of liquid working fluid, as shown in the arrangement of inlets and outlets shown in FIG. 3B.

Figure 4:
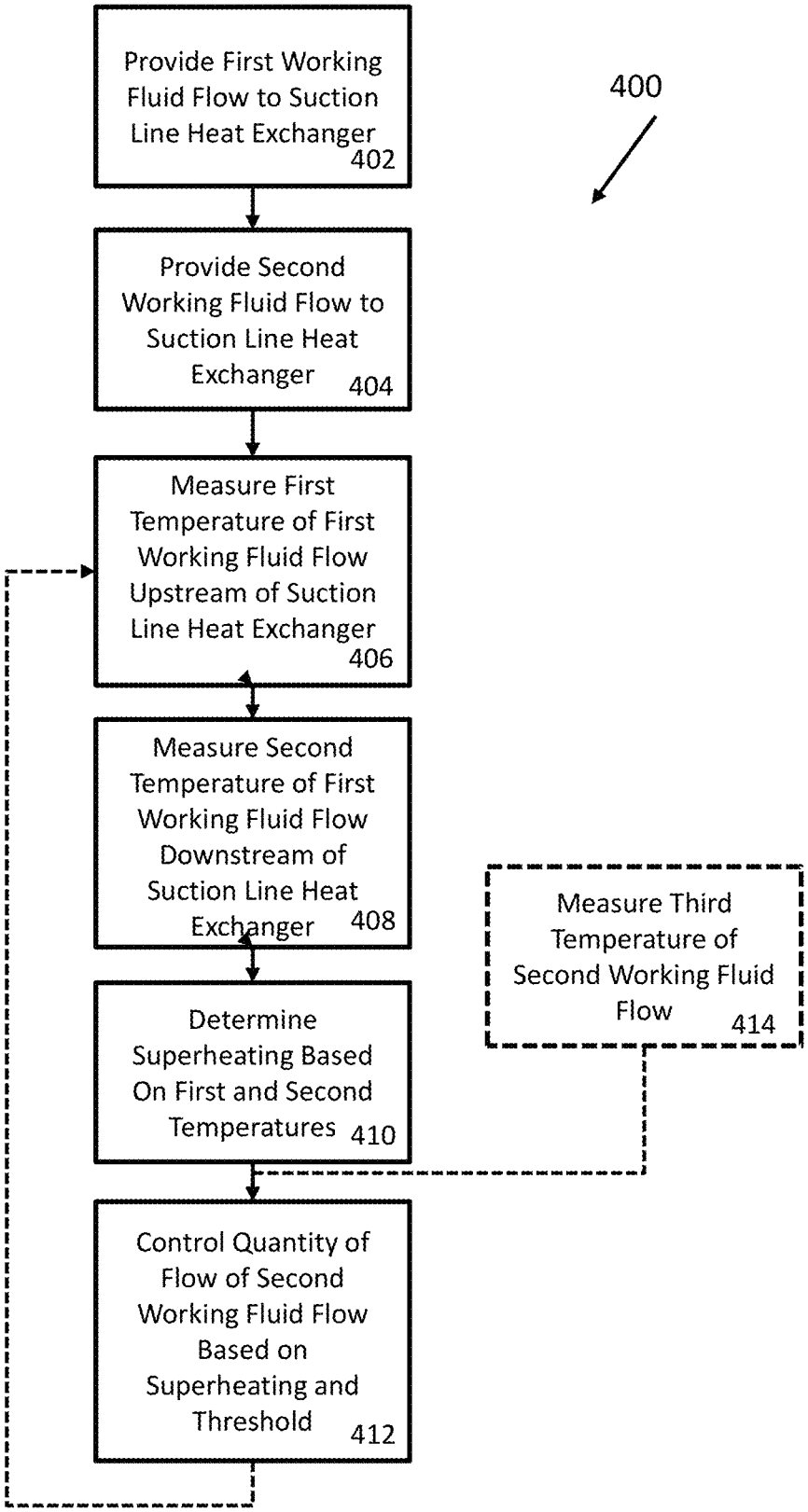
FIG. 4 is a flowchart of a method according to an embodiment.

FIG. 4 is a flowchart of a method 400 according to an embodiment. Method 400 includes providing a first working fluid flow to a suction line heat exchanger 402 and providing a second working fluid flow to the suction line heat exchanger 404. Method 400 further includes receiving a first temperature of the first working fluid flow directly upstream of the suction line heat exchanger 406 and receiving a second temperature of the first working fluid flow directly downstream of the suction line heat exchanger 408. Method 400 also includes determining a superheat generation 410 based on the first temperature and the second temperature, and controlling a quantity of flow of the second working fluid flow to the suction line heat exchanger 412 based on the superheat generation and a threshold superheat value. Optionally, a third temperature in the second working fluid flow can be received 414.

Method 400 includes providing a first working fluid flow to a suction line heat exchanger 402. The first working fluid flow may be a flow of a working fluid from a heat exchanger receiving the working fluid from an expansion device towards a suction of a compressor of an HVACR circuit in which method 400 is being performed. In an embodiment, the first working fluid flow is of a gas at a relatively low temperature. In an embodiment, the first working fluid flow is of suction gas in the HVACR circuit. In an embodiment where the HVACR circuit is incorporated into a chiller, the first working fluid flow may be from an evaporator used to absorb heat from a process fluid such as air or water. In an embodiment where the HVACR circuit is incorporated into a heat pump, the first working fluid flow may be from either an outdoor heat exchanger being used as an evaporator to absorb heat from an ambient environment when in a heating mode, or a heat exchanger being used as an evaporator to absorb heat from a process fluid such as air or water when the HVACR circuit is in a cooling mode.

Method 400 also includes providing a second working fluid flow to the suction line heat exchanger 404. The second working fluid flow may be a flow of working fluid from a heat exchanger that receives working fluid from the discharge of a compressor of the HVACR circuit towards an expansion device of the HVACR circuit. In an embodiment, the second working fluid flow is from a liquid line in the HVACR circuit. In an embodiment, the second working fluid flow is a relatively warm liquid flow (i.e. at a temperature higher than that of the first working fluid flow provided at 402). In an embodiment where the HVACR circuit is incorporated into a chiller, the second working fluid flow may be from a condenser used to reject heat to an ambient environment and upstream of an expansion device of the HVACR circuit. In an embodiment where the HVACR circuit is incorporated into a heat pump, the second working fluid flow may be from an indoor unit operating as a condenser to heat a process fluid such as air or water to provide heating in a heating mode, or a heat exchanger operating as a condenser to reject heat to an ambient environment when in a heating mode.

In an embodiment, the first working fluid flow provided at 402 and the second working fluid flow provided at 404 are kept separate within the suction line heat exchanger, exchanging heat with one another without any mixing occurring. In an embodiment, the suction line heat exchanger is a counter flow heat exchanger, where the first working fluid flow provided at 402 and the second working fluid flow provided at 404 respectively travel in directions opposite to one another in at least a portion of the suction line heat exchanger.

A first temperature of the first working fluid flow directly upstream of the suction line heat exchanger is received 406. The first temperature may be obtained from, for example, a temperature sensor located directly upstream of the suction line heat exchanger. Directly upstream of the suction line heat exchanger is understood as being where no other component of the fluid circuit such as a heat exchanger, compressor, etc. are between the point of measurement and the suction line heat exchanger, aside from the fluid line conveying the working fluid to the suction line heat exchanger. The first temperature received at 406 may be measured at an inlet of the suction line heat exchanger. The first temperature received at 406 may be measured along a fluid line between the outlet of the heat exchanger receiving working fluid from the expansion device and the inlet of the suction line heat exchanger. The first temperature may be communicated to a controller via an operational coupling such as a wired or wireless connection between a temperature sensor taking the measurement and the controller.

A second temperature of the first working fluid flow directly downstream of the suction line heat exchanger is received at 408. Directly downstream of the suction line heat exchanger is understood as being anywhere between the suction line heat exchanger and the next component of the fluid circuit other than a fluid line following the suction line heat exchanger, such as the suction of the compressor. The second temperature received at 408 may be obtained from, for example, a temperature sensor. The second temperature is a temperature of the first working fluid flow between the outlet of the suction line heat exchanger and a suction of the compressor of the HVACR circuit where method 400 is performed. In an embodiment, the second temperature is received 408 at the outlet of the suction line heat exchanger. In an embodiment, the second temperature is received 408 along a fluid line connecting the suction line heat exchanger to the suction of the compressor. The second temperature may be communicated to a controller via an operational coupling such as a wired or wireless connection between a temperature sensor taking the measurement and the controller.

A superheat generation is determined 410 based on the first temperature and the second temperature. The superheat generation 410 is a measure of the superheat added to the suction gas by the suction line heat exchanger. In an embodiment, the superheat generation is determined as the difference between the second temperature received at 408 and the first temperature received at 406. In an embodiment, the superheat generation may be determined 410 by a controller receiving the first temperature at 406 and the second temperature received at 408, for example by an operative coupling such as a wired or wireless connection between the controller and the sensors measuring the respective first and second temperatures.

A quantity of flow of the second working fluid flow to the suction line heat exchanger is controlled 412 based on the superheat generation determined at 410 and a threshold superheat value. The threshold superheat value may be a value of superheat that is permissible for HVACR circuit during method 400. The threshold superheat value may be based on parameters such as, for example, the design of the HVACR circuit and optionally the amount of working fluid that HVACR circuit has been charged with. In an embodiment, the threshold superheat value is determined based on a superheat setpoint of the HVACR circuit 100. In an embodiment, the threshold superheat value may be at or about 4° C. The threshold superheat value may be a value selected based on one or more of, for example, avoiding liquid slugging or improving stability at an expansion device. The threshold superheat value may further be dynamic with the variation in the threshold superheat value being based at least in part on, for example, ambient air temperature, saturated suction temperature, and/or compressor load of a compressor of the HVACR system. In an embodiment, when the superheat generation determined at 410 exceeds the threshold superheat value, the quantity of flow of the second working fluid flow may be reduced at 412. In an embodiment, when the superheat generation determined at 410 is less than the threshold superheat value, the quantity of flow of the second working fluid flow may be maintained or increased at 412. In an embodiment, the quantity of flow of the second working fluid flow and the superheat generation may be used to determine a relationship between the quantity of flow of the second working fluid flow into the suction line heat exchanger and the superheat generation, and this relationship may be used to determine a value for the quantity of flow of the second working fluid flow to provide superheating at or near the threshold superheat value.

In an embodiment, control of the quantity of flow of the second working fluid flow may be achieved through the controller directing a flow director to operate. The flow director controlled by the controller to effect control of the quantity of flow of the second working fluid flow at 412 may be one or more flow controls that are configured to control the quantity of fluid allowed to flow into the suction line heat exchanger. The flow director may, for example, allocate the flow of fluid between the suction line heat exchanger and a bypass line that allows fluid to continue flow through the HVACR circuit without passing through the suction line heat exchanger. In an embodiment, the flow director is a three-way valve. In an embodiment, the flow director is a motorized, stepped three-way valve. In an embodiment, the flow director has one input, a first outlet from which fluid passes to suction line heat exchanger, and a second outlet from which fluid passes to bypass line. In an embodiment, the flow director includes at least two variable-position valves. In this embodiment, the at least two variable-position valves may be controlled in a complementary fashion, where the extent of opening of each valve is controlled with respect to the others to allocate the flow among the suction line heat exchanger and the bypass line. In an embodiment, the control of the at least two variable-position valves is proportional control. In an embodiment, the flow director includes multiple valves of varying aperture size for each of the suction line heat exchanger and bypass line and the allocation of flow is achieved by opening or closing one or more of those multiple valves Optionally, a third temperature in the second working fluid flow can be received 414. The temperature can be measured upstream of the flow director used to control the quantity of flow of the second working fluid flow to the suction line heat exchanger at 412. The third temperature may be used by the controller to further determine the quantity of flow of the second working fluid to be directed to the suction line heat exchanger at 412. For example, the third temperature can be a parameter used to determine an expected superheating provided by a quantity of flow of the second working fluid flow into the suction line heat exchanger at 412, and the expected superheating used to provide superheating in an amount below the threshold superheat value.

In an embodiment, the method 400 may be continuous. In an embodiment, the method 400 may iterate by returning from the control of the quantity of the flow of the second working fluid flow at 412 to the measurement of the first temperature at 406, either continuously, at set intervals, or based on triggers such as changes in operating conditions.

Aspects:

It is understood that any of aspects 1-14 can be combined with any of aspects 15-22.

Aspect 1. A heating, ventilation, air conditioning, and refrigeration (HVACR) circuit, comprising:

a compressor having a suction and a discharge;

a first heat exchanger;

an expander;

a second heat exchanger;

a suction line heat exchanger, configured to exchange heat between a first working fluid flow, wherein the first working fluid flow is a flow of working fluid from one of the first heat exchanger or the second heat exchanger to the suction of the compressor, and a second working fluid flow, wherein the second working fluid flow is a flow of working fluid from the other of the first heat exchanger or the second heat exchanger towards the expander;

a flow director configured to regulate an amount of the second working fluid flow entering the suction line heat exchanger; and a controller, configured to:

receive a first temperature of the first working fluid flow prior to entering the suction line heat exchanger;

receive a second temperature of the first working fluid flow between the suction line heat exchanger and the suction of the compressor;

determine a superheat generation at the suction line heat exchanger based on the first temperature and the second temperature; and control the flow director based on the superheat generation and a threshold superheat value.

Aspect 2. The HVACR circuit according to aspect 1, wherein the controller is further configured to receive a third temperature of the second working fluid flow prior to entering the flow director or at an inlet of the flow director further control the flow director based on the third temperature.

Aspect 3. The HVACR circuit according to any of aspects 1-2, wherein the first heat exchanger is an outdoor heat exchanger receiving working fluid from the discharge of the compressor, the second heat exchanger is an evaporator, the first working fluid flow is from the second heat exchanger to the suction of the compressor, and the second working fluid flow is from the first heat exchanger to the expander.

Aspect 4. The HVACR circuit according to any of aspects 1-2, further comprising a flow reverser configured to direct a discharge of the compressor to one of the first heat exchanger or the second heat exchanger.

Aspect 5. The HVACR circuit according to aspect 4, wherein the HVACR circuit is in a cooling mode when the flow reverser directs a discharge of the compressor to the first heat exchanger, and a heating mode when the flow reverser directs the discharge of the compressor to the second heat exchanger.

Aspect 6. The HVACR circuit according to aspect 5, wherein when in the cooling mode, the first working fluid flow is from the second heat exchanger to the suction of the compressor, and the second working fluid flow is from the first heat exchanger to the expander.

Aspect 7. The HVACR circuit according to any of aspects 5-6, wherein when in the heating mode, the first working fluid flow is from the first heat exchanger to the suction of the compressor, and the second working fluid flow is from the second heat exchanger to the expander.

Aspect 8. The HVACR circuit according to any of aspects 1-7, wherein the suction line heat exchanger is a counter-flow heat exchanger.

Aspect 9. The HVACR circuit according to any of aspects 1-8, wherein the flow director comprises a stepped three-way valve and a bypass line.

Aspect 10. The HVACR circuit according to any of aspects 1-8, wherein the flow director comprises a plurality of controllable valves, and wherein the controller is configured to operate the plurality of controllable valves proportionally.

Aspect 11. The HVACR circuit according to any of claims 1-10, wherein controlling the flow director based on the superheat generation and a threshold superheat value comprises regulating the second working fluid flow such that the superheat generation is less than the threshold superheat value.

Aspect 12. The HVACR circuit according to aspect 11, wherein the threshold superheat value is at or about 4° C.

Aspect 13 The HVACR circuit according to any of aspects 1-12, further comprising a first temperature sensor located upstream of the suction line heat exchanger with respect to the first working fluid flow, and wherein the controller receives the first temperature from the first temperature sensor.

Aspect 14. The HVACR circuit according to any of aspects 1-13, further comprising a second temperature sensor located between the suction line heat exchanger and the suction of the compressor, and wherein the controller receives the second temperature from the second temperature sensor.

Aspect 15. A method of operating a heating, ventilation, air conditioning, and refrigeration (HVACR) circuit, comprising:

providing a first working fluid flow through a suction line heat exchanger, wherein the first working fluid flow is a working fluid flow from a first heat exchanger to a suction of a compressor; providing a second working fluid flow through the suction line heat exchanger, separate from the first working fluid flow, wherein the second working fluid flow is a working fluid flow from a second heat exchanger to an expander, and the first working fluid flow and the second working fluid flow exchange heat in the suction line heat exchanger;

receiving a first temperature of the first working fluid flow at a position directly upstream of the suction line heat exchanger;

receiving a second temperature of the first working fluid flow at a position directly downstream of the suction line heat exchanger;

determining a superheat generation based on the first temperature and the second temperature; controlling a quantity of flow of the second working fluid flow through the suction line heat exchanger based on the superheat generation and a threshold superheat value.

Aspect 16. The method according to aspect 15, wherein the quantity of flow of the second working fluid flow is controlled such that the superheat generation does not exceed the threshold superheat value.

Aspect 17. The method according to aspect 16, wherein the threshold superheat value is at or about 4° C.

Aspect 18. The method according to any of aspects 15-17, wherein controlling the quantity of flow of the second working fluid flow comprises directing a portion of the second working fluid flow to a bypass line via a stepped three-way valve.

Aspect 19. The method according to any of aspects 15-17, wherein controlling the quantity of flow of the second working fluid flow comprises operating a plurality of controllable valves proportionally to allocate flow between a bypass line and the suction line heat exchanger.

Aspect 20. The method according to any of aspects 15-19, further comprising receiving a third temperature, wherein the third temperature is a temperature of the second working fluid flow, and wherein controlling the quantity of flow of the second working fluid flow is further based on the third temperature.

Aspect 21. The method according to any of aspects 15-20, wherein the suction line heat exchanger is a counter-flow heat exchanger wherein the first working fluid flow travels through the suction line heat exchanger in a first direction, and the second working fluid flow travels through the suction line heat exchanger in a second direction, wherein the second direction is opposite the first direction.

Aspect 22. The method according to any of aspects 15-21, wherein the HVACR circuit is a heat pump circuit, the first heat exchanger is a heat exchanger receiving working fluid from the expander, and the second heat exchanger is a heat exchanger receiving working fluid from a discharge of the compressor.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of operating a heating, ventilation, air conditioning, and refrigeration (HVACR) circuit, comprising:

providing a first working fluid flow through a suction line heat exchanger, wherein the first working fluid flow is a working fluid flow from a first heat exchanger to a suction of a compressor;

providing a second working fluid flow through the suction line heat exchanger, separate from the first working fluid flow, wherein the second working fluid flow is a working fluid flow from a second heat exchanger to an expander, and the first working fluid flow and the second working fluid flow exchange heat in the suction line heat exchanger;

receiving a first temperature of the first working fluid flow at a position directly upstream of the suction line heat exchanger;

receiving a second temperature of the first working fluid flow at a position directly downstream of the suction line heat exchanger;

determining a superheat generation based on the first temperature and the second temperature;

controlling a quantity of flow of the second working fluid flow through the suction line heat exchanger based on the superheat generation and a threshold superheat value.

2. The method of claim 1, wherein the quantity of flow of the second working fluid flow is controlled such that the superheat generation does not exceed the threshold superheat value.

3. The method of claim 2, wherein the threshold superheat value is 4° C.

4. The method of claim 1, wherein controlling the quantity of flow of the second working fluid flow comprises directing a portion of the second working fluid flow to a bypass line via a stepped three-way valve.

5. The method of claim 1, wherein controlling the quantity of flow of the second working fluid flow comprises operating a plurality of controllable valves proportionally to allocate flow between a bypass line and the suction line heat exchanger.

6. The method of claim 1, further comprising receiving a third temperature, wherein the third temperature is a temperature of the second working fluid flow, and wherein controlling the quantity of flow of the second working fluid flow is further based on the third temperature.

7. The method of claim 1, wherein the suction line heat exchanger is a counter-flow heat exchanger wherein the first working fluid flow travels through the suction line heat exchanger in a first direction, and the second working fluid flow travels through the suction line heat exchanger in a second direction, wherein the second direction is opposite the first direction.

8. The method of claim 1, wherein the HVACR circuit is a heat pump circuit, the first heat exchanger is a heat exchanger receiving working fluid from the expander, and the second heat exchanger is a heat exchanger receiving working fluid from a discharge of the compressor.

* * * * *